US006518866B1

(12) United States Patent
M'Sadoques

(10) Patent No.: US 6,518,866 B1
(45) Date of Patent: Feb. 11, 2003

(54) CIRCUIT BREAKER COMPARTMENT DOOR

(75) Inventor: Andre J. M'Sadoques, Southington, CT (US)

(73) Assignee: General Electric Company, Schenectady, NY (US)

( * ) Notice: Subject to any disclaimer, the term of this patent is extended or adjusted under 35 U.S.C. 154(b) by 551 days.

(21) Appl. No.: 08/903,406

(22) Filed: Jul. 30, 1997

(51) Int. Cl.[7] ..... H01H 13/04
(52) U.S. Cl. ..... 335/202; 335/132
(58) Field of Search ..... 335/131–2, 202, 335/6; 200/193–5

(56) References Cited

U.S. PATENT DOCUMENTS 3,084,238 A 4/1963 Baskerville
3,095,489 A 6/1963 Baird
4,400,672 A * 8/1983 Bottelson ..... 335/202
4,728,914 A * 3/1988 Morris et al. ..... 335/6
5,117,211 A * 5/1992 Morgan et al. ..... 335/202
5,151,842 A 9/1992 DeBiasi et al.

* cited by examiner

*Primary Examiner*—Lincoln Donovan
(74) *Attorney, Agent, or Firm*—Cantor Colburn LLP

(57) ABSTRACT

A circuit breaker programmer enclosure in the form of a plastic housing having an external access door houses the electronic trip unit and accessories that control the circuit breaker operation. The door assumes two positions when arranged on the housing for both excluding and allowing access to the circuit breaker rating plug and trip unit adjustment knobs. In one position, access is made to both the rating plug and trip unit adjustment knobs while in another position access to the rating plug and trip unit is denied.

7 Claims, 4 Drawing Sheets

CIRCUIT BREAKER COMPARTMENT DOOR

BACKGROUND OF THE INVENTION

Electronic circuit breakers such as described within U.S. Pat. No. 5,151,842 entitled "Switchboards and Panelboards Having Interlock and Load Selection Capabilities" are enclosed within closed compartments to which visual access is made to displays, meters and the like to ascertain the status of the enclosed circuit breakers. To prevent unauthorized access to the circuit breaker settings, some type of a locked compartment door is employed.

Air circuit breakers as described within U.S. Pat. No. 3,095,489 entitled "Manual Charging Means for Stored Energy Closing Mechanisms of Electric Circuit Breakers" and U.S. Pat. No. 3,084,238 entitled "Ratchet Mechanism for Charging a Closing Springs in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

When electronic trip unit programmers are used with such exposed air circuit breakers, a circuit breaker cover such as shown in U.S. patent application Ser. No. 08/863,667 filed on May 27, 1997 entitled "Manual Charging Mechanism for Industrial-Rated Circuit Breaker" is used to cover and protect the electronic components used within the electronic trip units while allowing visual access to the trip unit display.

In the event that adjustments are required with respect to the trip unit settings, some arrangement must be made to allow gated access to the trip unit settings without having to expose the remaining circuit breaker electrical components.

One purpose of the invention is to provide a circuit breaker cover that provides security to the circuit breaker operating components while allowing gated access to the trip unit adjustment knobs for test, adjustment and calibration of the trip unit settings.

SUMMARY OF THE INVENTION

An insulative circuit breaker cover is provided with a separate door covering the circuit breaker trip unit programmer unit. A visual access slot is formed in the door for viewing the circuit breaker display and a rating plug access slot is formed therein for inserting the circuit breaker burden resistor. A lockable door allows access to the circuit breaker programmer that houses the trip unit for test, adjustment and calibration thereof.

DESCRIPTION OF THE PREFERRED EMBODIMENT

Figure 1:
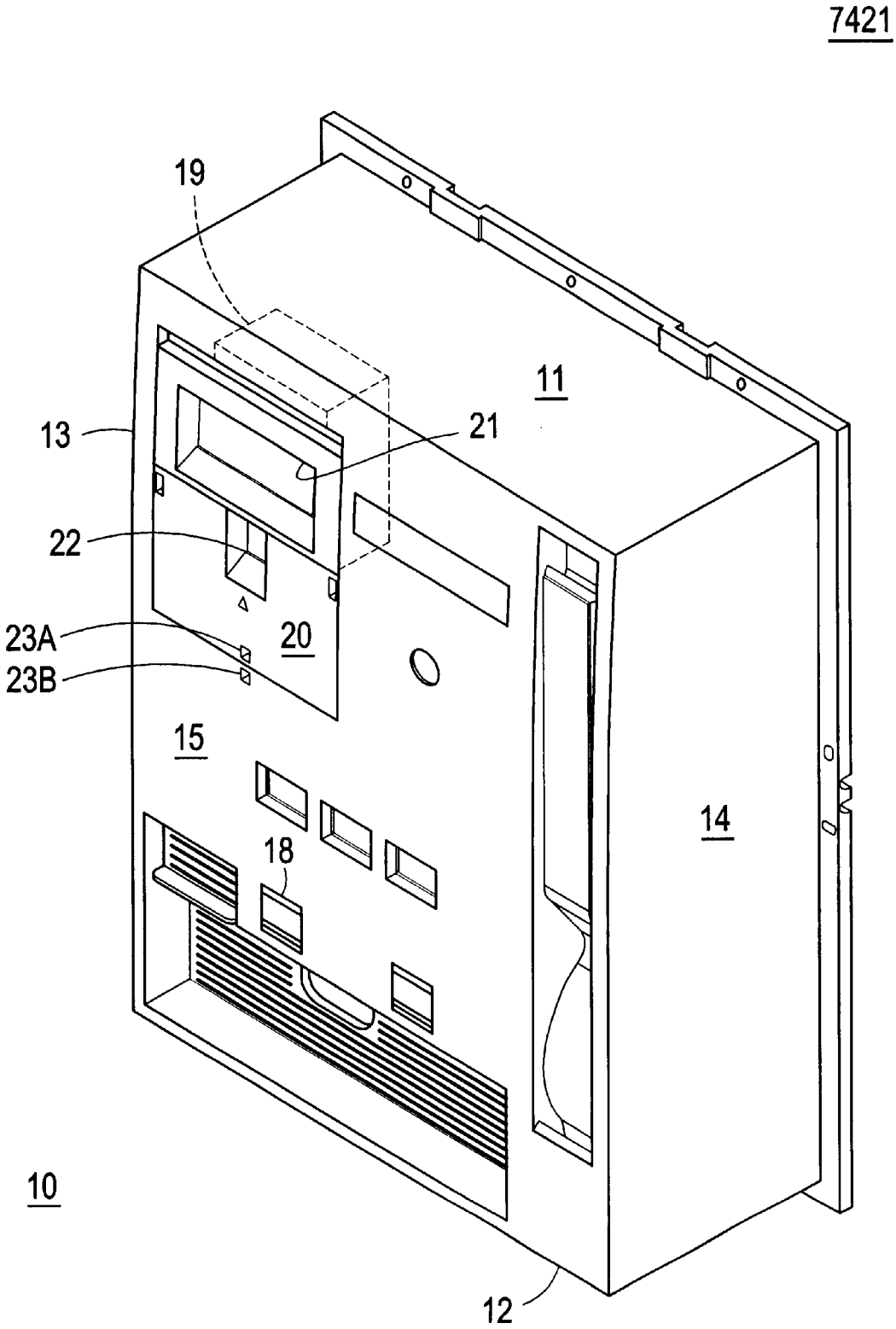
FIG. 1 is a top perspective view of a circuit breaker cover containing the programmer cover in accordance with the invention.
Figure 2:
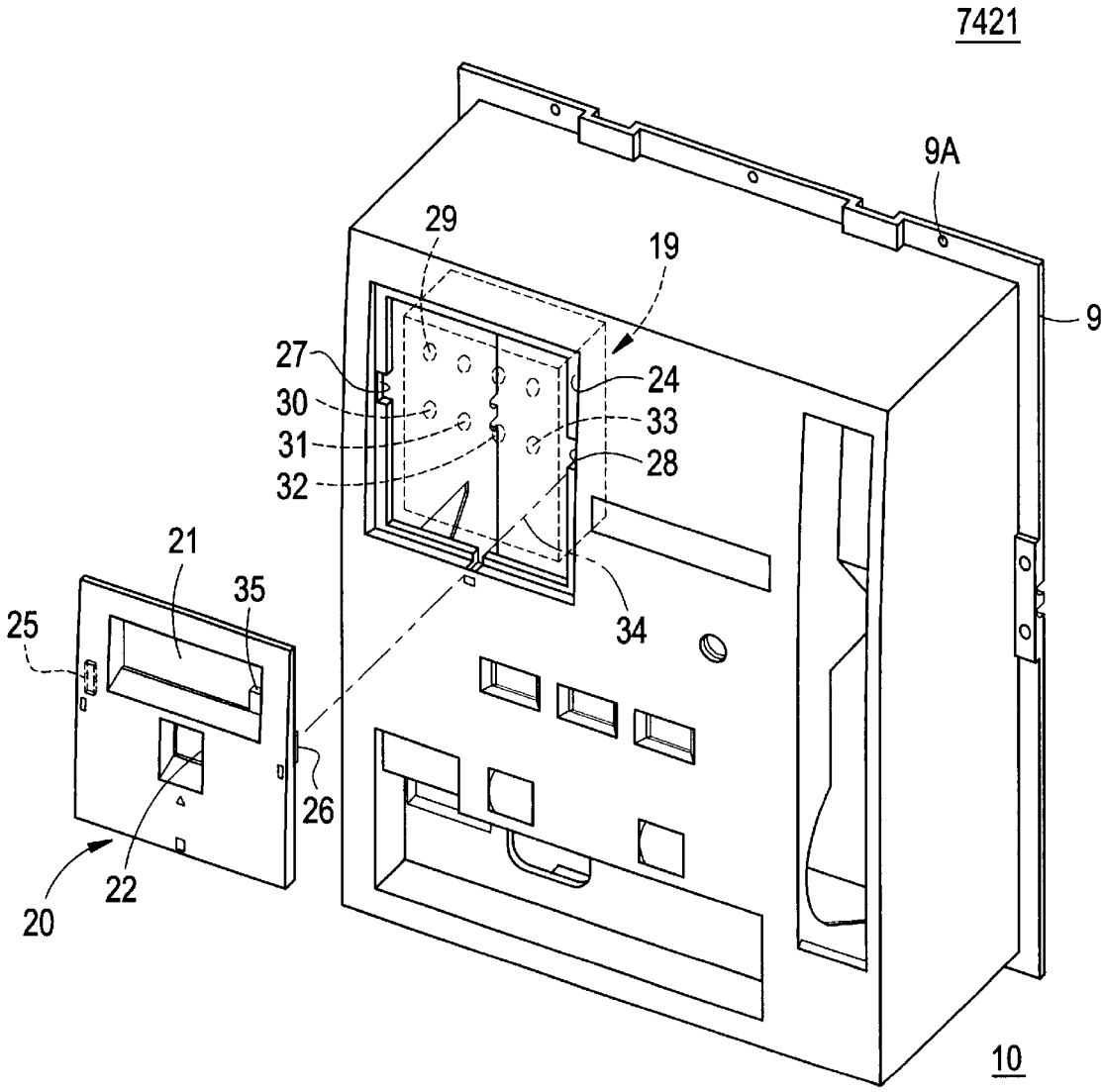
FIG. 2 is a top perspective view of the circuit breaker cover of FIG. 1 with the programmer cover in isometric projection prior to attachment.

A circuit breaker cover 10 is depicted in FIG. 1 in the form of a molded plastic piece defining opposing top and bottom walls 11, 12 and opposing side walls 13, 14. The front face 15 includes a circuit breaker handle operator 16 within a recess 17 for manual control of the circuit breaker contacts (not shown) in the manner described within the aforementioned U.S. Pat. No. 3,095,489. Operating buttons 18 are used for opening and closing the circuit breaker contacts in lieu of the operating handle. A programmer unit 19 containing an electronic trip unit such as that described within the aforementioned U.S. Pat. No. 5,151,842 is positioned within the circuit breaker cover and is accessed by means of a separate programmer cover 20 that includes a window 21 for viewing the programmer indicator diodes 29 (FIG. 2) and a rating plug access opening 22 for accessing the trip unit rating plug 34 (FIG. 2). Apertures 23A in the programmer cover 20 and 23B in the circuit breaker front face 15 are used to receive a lock hasp or suitable locking wire to prevent unauthorized access to the programmer components as best seen by referring now to FIG. 2.

Figure 3:
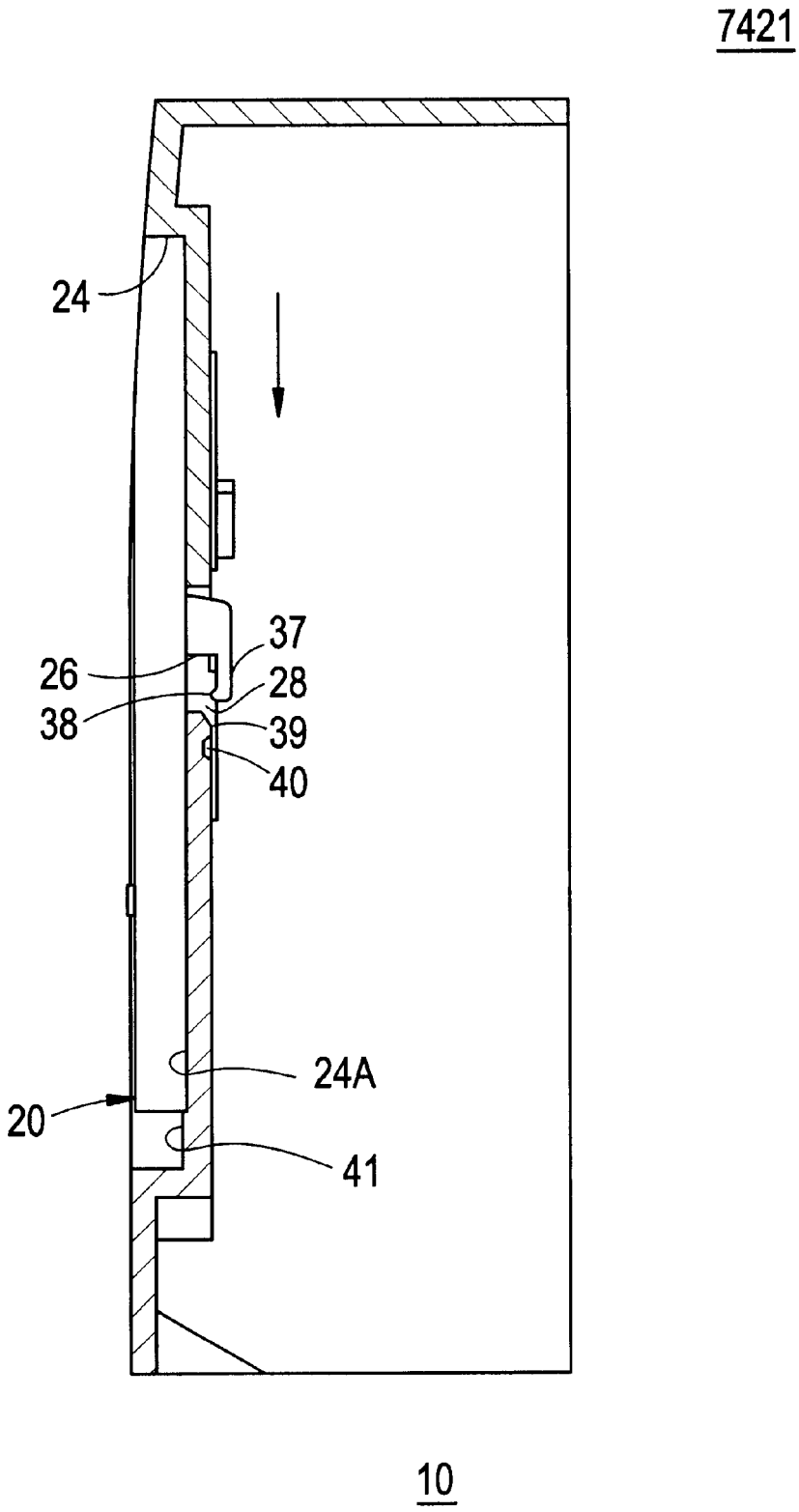
FIG. 3 is a side sectional view of the circuit breaker cover of FIG. 1 with the programmer cover inserted therein prior to entrapment.
Figure 4:
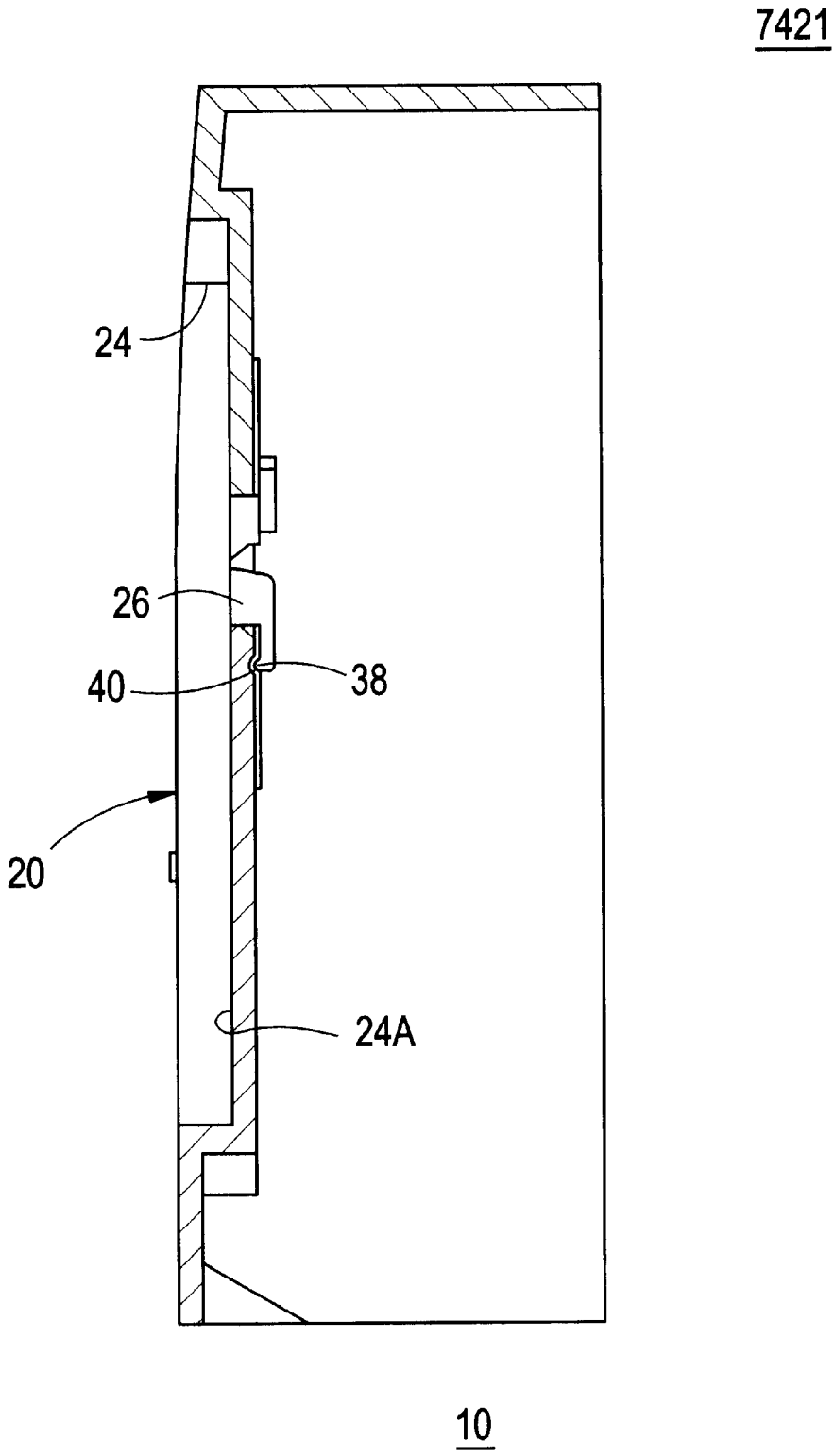
FIG. 4 is a side sectional view of the circuit breaker cover of FIG. 1 with the programmer cover entrapped therein.

The circuit breaker cover 10 is depicted to include a perimetric rim 9 having several apertures 9A for attaching to a circuit breaker enclosure (not shown). The programmer 19 is shown within the circuit breaker cover access opening 24 and is of the type including 30 indicating diodes 29 along a top thereof with the long time overcurrent values set by means of the potentiometer 30, the long time delay set by means of the potentiometer 31 and the short time overcurrent values set by means of the potentiometer 32. The aforementioned potentiometers are accessible through the window 21 when the programmer cover 20 is positioned in the access opening 24 by insertion of the tabs 25, 26 within the corresponding slots 27, 28 in the manner to be described below. An important feature of the invention is the provision of the blocking tab 35 within the window 21 which is positioned to block access to the short time delay potentiometer 33 while allowing access to the remaining potentiometers. The short time delay should be set to coordinate with the circuit breaker ampere rating that is determined by the rating plug 34, which rating plug is accessible via the rating plug access opening 22. The programmer cover 20 is inserted in the manner best seen by now referring to FIGS. 3 and 4.

The programmer cover 20 is first inserted within the access opening 24 within the circuit breaker cover 10 by guiding the tab 26 on one side of the programmer cover 20 within the slot 28. There are corresponding tabs and slots on the opposite side of the programmer cover and circuit breaker cover that operate in a similar manner. However, only one tab 26 is shown herein for purposes of clarity. The tab 26 is integrally-formed within the programmer cover 20 and includes a leg extension 37 having a detent 38 formed on the end thereof. The access opening 24 includes a perimetric step 24A which surrounds the opening and further includes a detent slot 40 under the slot 28 with a ramped surface 39 formed on the edge of the slot 28. In the position shown in FIG. 3, there is a bottom gap 41 existing between the bottom of the programmer cover 20 and the bottom edge of the access opening 24 as indicated at 41. To capture the programmer cover 20 within the access opening 24, the programmer cover is moved in the downward indicated direction to the position shown in FIG. 4 wherein the detent 38 on the bottom of the leg extension 37 is captured within the detent slot 28 to lockingly retain the programmer door within the trip unit cover 10.

A programmer door for positioning over a trip unit programmer within a circuit breaker cover has herein been described. The programmer door includes means for preventing access to a selected one of the trip unit potentiometers while allowing access to others. Also provided are apertures for insertion of a locking hasp to prevent unauthorized removal of the programmer door once the programmer unit has been inserted.

What is claimed is:

1. A circuit breaker cover comprising:

a circuit breaker enclosure defining a front face joined by opposing side walls and a top and a bottom wall;

a circuit breaker operating handle recess formed in said front face;

a programmer cover access slot formed in said front face;

a perimetric step around said programmer cover access slot;

a pair of opposing guide slots formed on said perimetric step on opposite sides of said programmer cover access slot; and a programmer cover arranged within said programmer cover access slot, said programmer cover defining a plate having a window formed therein for visual access to the interior of a circuit breaker cover, wherein said plate has a pair of first and second guide tabs on opposite sides of said plate arranged for reception within said opposing guide slots, said first and second guide tabs including detents for capture within said guide slots formed on said perimetric step.

2. The circuit breaker cover of claim 1 including a rating plug access slot for allowing access to a rating plug inserted within a circuit breaker programmer unit.

3. The circuit breaker cover of claim 2 further including a blocking tab formed on said plate within said window for defeating access to a trip unit programmer control knob.

4. The circuit breaker cover of claim 2 wherein said plate is undersized with respect to a circuit breaker cover access opening for allowing lateral movement of said plate along a perimeter defined along a circuit breaker cover access opening.

5. The circuit breaker of claim 2 further including a locking aperture at one end of said plate proximate a locking aperture at one end of a circuit breaker cover access opening for receiving said detents on said guide tabs for retaining said plate to a circuit breaker cover.

6. A programmer cover for preventing access to a circuit breaker programmer unit comprising:

a plate having a window formed therein for visual access to the interior of a circuit breaker cove;

a rating plug access slot for allowing access to a rating plug inserted within a circuit breaker programmer unit;

a pair of first and second guide tabs arranged on opposite sides of said plate for reception within corresponding slots formed on opposite sides of said circuit breaker cover, wherein said first and second guide tabs include detents for capture within said slots of said circuit breaker cover, said detents for retaining said plate within said slots of said circuit breaker cover, and a blocking tab formed on said plate within said window for defeating access to a trip unit programmer control knob.

7. The programmer cover of claim 6 further including a locking aperture at one end of said plate proximate a locking aperture at one end of a circuit breaker cover access opening for receiving said detents on said guide tabs for retaining said plate to a circuit breaker cover.

* * * * *

UNITED STATES PATENT AND TRADEMARK OFFICE

CERTIFICATE OF CORRECTION

PATENT NO. : 6,518,866 B1
DATED : February 11, 2003
INVENTOR(S) : M'Sadoques

It is certified that error appears in the above-identified patent and that said Letters Patent is hereby corrected as shown below:

Column 2,
Line 23, after "including" delete "30".

Column 4,
Line 12, after "breaker" delete "cove" and insert -- cover --.

Signed and Sealed this

Seventeenth Day of January, 2006

JON W. DUDAS
*Director of the United States Patent and Trademark Office*